United States Patent [19]

Masuda

[11] 4,011,991

[45] Mar. 15, 1977

[54] ELECTROSTATIC POWDER PAINTING APPARATUS

[76] Inventor: Senichi Masuda, 40-10-605, 1-chome, Nishigahara, Kita-ku, Tokyo, Japan

[22] Filed: July 29, 1975

[21] Appl. No.: 599,994

[30] Foreign Application Priority Data

Aug. 4, 1974 Japan ..... 49-89351

[52] U.S. Cl. ..... 239/15; 118/629; 361/227

[51] Int. Cl.[2] ..... B05B 5/02; B05C 5/00

[58] Field of Search ..... 239/3, 15; 118/621, 118/624, 626–633, 635, 636, 638, 640; 317/3, 262 R; 427/12, 25, 26, 30, 39

[56] References Cited

UNITED STATES PATENTS

| | | | |
|---|---|---|---|
| 2,955,565 | 10/1960 | Schotland | 239/15 X |
| 3,476,082 | 11/1969 | Cowles | 239/15 X |
| 3,778,678 | 12/1973 | Masuda | 118/621 X |
| 3,806,763 | 4/1974 | Masuda | 317/3 |
| 3,841,264 | 10/1974 | Masuda | 118/629 X |
| 3,976,031 | 8/1976 | Itoh | 118/638 X |

*Primary Examiner*—Evon C. Blunk
*Assistant Examiner*—Andres Kashnikow
*Attorney, Agent, or Firm*—Price, Heneveld, Huizenga & Cooper

[57] ABSTRACT

An improved electrostatic powder painting apparatus is described herein, in which in the vicinity of a discharge electrode disposed in opposition to a body to be painted there is separately provided a driving electrode, for establishment of a driving electric field. The generation of a mono-polar ion current is achieved by said discharge electrode, so that the driving electric field and the ion current density may be controlled quite independently of each other, whereby generation of inverse ionization can be prevented perfectly, while a maximum amount of electric charge can be given to paint powders and a maximum driving force is acted upon said paint powders.

16 Claims, 10 Drawing Figures

ELECTROSTATIC POWDER PAINTING APPARATUS

Figure 1:
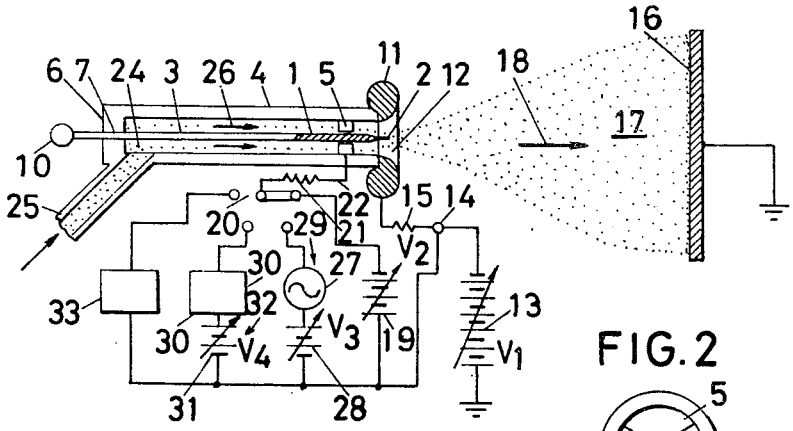

The present invention relates to an electrostatic painting apparatus for electrostatically applying powders such as paint to a body.

Electrostatic powder painting apparatuses in the prior art operated on the basis that said apparatus is provided with a corona discharge electrode that is applied with a D.C. high voltage to generate a mono-polar D.C. corona discharge from said discharge electrode towards a grounded body to be painted. This produces a mono-polar ion current therebetween and simultaneously establishes an electric field (hereinafter referred to as "driving electric field") between said discharge electrode and said body to be painted. Paint powders to be applied are supplied to the vicinity of said discharge electrode by appropriate powder supply means, and said paint powders are charged by collision with said ion current and also driven to said body to be painted by a Coulomb's force under the action of said driving electric field, and thereby said paint powders are adhered onto the body to be painted. In this case, during the process of painting if powders having a high electric resistance such as plastics accumulate on the body to be painted in a layer form, then all the ion current passing through the space flows into the body to be painted via this layer. As a result, assuming that a virtual specific electric resistance of the powder layer is represented by $\rho d[\Omega.cm]$ and a current density within said powder layer (this being equal to a current density $ig$ of the ion current in the space outside of the layer at its surface) is represented by $id[A/cm^2]$, an electric field having a virtual field strength of $Ed = \rho d \times id$ that is a product of the above-referred factors is established. Owing to this electric field, an electric adhesive force is acted upon the powder layer to cause said powder layer to be adhered under pressure onto the body to be painted and thus good painting can be achieved. However, if the field strength $Ed$ becomes too large and eventually exceeds a break-down value $Eds$ (about $10^4$V/cm), then break-down will occur within the powder layer, so that pin holes are produced at this portion, resulting in great degradation in quality of the painted surface. Also corona discharge of an opposite polarity will arise from this portion and thus ions of opposite polarity are emitted into the driving electric field. Accordingly, the charge of the powders charged by the ions emitted from the discharge electrode is greatly neutralized, so that not only the electric force required for painting is reduced, but also the powders are charged in opposite polarity in the vicinity of the surface to be painted. Thus the powders are repelled, eventually resulting in great lowering of the painting efficiency. Such corona discharge of opposite polarity is called inverse ionization. Therefore, in order to achieve good painting operation while making the above-referred electric adhesive force effectively act upon the powder and yet obviate the adverse effect of inverse ionization, the painting must be carried out while satisfying the folllowing condition:

$$0 < \rho d \times id < Eds \qquad (1)$$

However, with the electrostatic powder painting apparatuses in the prior art, it was impossible to achieve stable painting while always satisfying the above condition, for the following reasons. The virtual specific resistance $\rho d$ is generally very high, and consequently, it is necessary to make the layer current density $id$ and thus the ion current density $ig$ very small for preventing the inverse ionization by satisfying the condition $0 < \rho \times id < Eds$. However, the ion current density $ig$ and the driving electric field strength are correlated by a definite function:

$$Eg = f(ig) \qquad (2)$$

and therefore, wide reduction of the ion current density $ig$ necessarily results in wide reduction of the driving electric field strength $Eg$, and thus results in a remarkable decrease of the electric driving force acted upon the powders that is necessary for painting (Since the quantity of electric charge Q acquired by the powders upon collision with ions is proportional to the driving electric field strength $Eg$, the Coulomb's force $F = Q \times Eg$ acted upon the powders is proportional to $Eg.^2$).

In other words, so long as the corona discharge for charging the powders and the establishment of the driving electric field are achieved with a single discharge electrode, the correlation as represented by formula (2) above cannot be obviated, and accordingly, with the electrostatic powder painting apparatus in the prior art which are based on the above-described construction, one could not avoid lowering of painting efficiency and painting quality caused by inverse ionization as described above.

It is one object of the present invention to provide a novel electrostatic powder painting apparatus which perfectly overcomes the above-mentioned disadvantage in the prior art, and which affords ideal painting efficiency and painting quality.

Another object of the present invention is to provide a novel electrostatic powder painting apparatus, in which whatever value the specific electric resistance $\rho d$ of the paint powders may take, always the condition represented by formula (1) above is satisfied by arbitrarily controlling the ion current so as to meet the value of the specific resistance, and thereby the generation of inverse ionization can be completely prevented.

Still another object of the present invention is to provide a novel electrostatic powder painting apparatus, in which a maximum amount of electric charge is given to powders and a maximum driving force is acted upon the powders by maintaining a driving electric field strength always at the highest permissible value independently of the above-mentioned control operation on the ion current. Thereby excellent function and effect can be achieved in that in whatever case the highest painting quality and the highest painting efficiency are attained.

According to one feature of the present invention, there is provided an electrostatic powder painting apparatus, in which in the vicinity of a discharge electrode is separately disposed another electrode (hereinafter referred to as a driving electrode) so that establishment of a driving electric field may be achieved by means of said driving electrode while production of a mono-polar ion current may be achieved by means of said discharge current, whereby the driving electric field strength $Eg$ and the ion current density $id$ ($= ig$) are made controllable completely independently of each other and thus the ion current density $id$ can be controlled so as to always satisfy the condition represented by formula (1) above while maintaining the driving electric field strength always at the highest value.

More particularly, the novel electrostatic powder painting apparatus according to the present invention is characterized in that said apparatus comprises a discharge electrode including a corona discharge portion having a small radius of curvature for producing corona discharge for charging powders, a driving electrode having a large radius of curvature which is disposed in the vicinity of said corona discharge portion as insulated from said driving electrode for electrically driving the charge powders towards a body to be painted, powder supply means for supplying paint powders to the vicinity of a corona discharge space formed between said corona discharge portion and said driving electrode, a driving D.C. high voltage source for applying a D.C. high voltage between said body to be painted and said driving electrode to establish a driving electric field which drives the charged powders towards said body to be painted so as to be adhered thereto, and a charging variable high voltage source for applying a variable high voltage of any arbitrary waveform between said discharge electrode and said driving electrode so that a variable corona discharge current consisting of a flow of ions of the same polarity as that of said driving electrode relative to said body to be painted may be fed from said corona discharge portion to said driving electric field, whereby said powders may be charged, driven and electrostatically adhered onto said body to be painted while controlling the magnitude of said corona current independently of the strength of said driving electric field so as to be matched with the nature of the paint powders.

The above-referred variable high voltage to be applied between said discharge electrode and said driving electrode according to the present invention could be a voltage of any appropriate waveform and magnitude, so long as it can eventually feed a variable current of mono-polar ions having the same polarity as that of said driving electrode relative to said body to be painted, from said corona discharge portion to said driving electric field. More particularly, any type of voltages such as, for example, (1) a variable D.C. high voltage, (2) a periodic voltage of any arbitrary waveform whose voltage and/or frequency is variable (for instance, a sinusoidal A.C. voltage, a repetitive pulse voltage, a pulsating voltage, etc.), and (3) a series connection of a periodic voltage of any arbitrary waveform (for instance, a sinusoidal A.C. voltage, a repetitive pulse voltage, a pulsating voltage, etc.) and a D.C. voltage, at least one of the voltage and frequency of the former and the voltage of the latter being variable.

In the apparatus according to the present invention, with regard to the physical configuration of said discharge electrode and said driving electrode, any appropriate shape could be employed. For instance, (1) the corona discharge portion of said discharge electrode could be constructed in an axially symmetrical form such as, for example, needle-point, disc, circular wire or inverse cone, with said driving electrode disposed so as to surround said corona discharge portion, or else (2) the corona discharge portions could be constructed as a row of aligned thin wires, knife-edges or needle-points disposed in a rectilinear or curved form, with driving electrodes of any appropriate shape (for instance, rod-shape, strip-shape, mesh-shape, etc.) disposed so as to sandwich said corona discharge portions and spaced therefrom at equal intervals. Furthermore, (3) depending upon the shape of the body to be painted, the charging/driving system consisting of said discharge electrode and said driving electrode could be used in multiple as integrally and fixedly disposed on a plane or on a curved surface to be operated in parallel, although the charging/driving system can be used singly. Still further, (4) the above-referred charging/driving system or systems could be used as fixedly disposed on a planar or curved wall body made of a conductor, a semiconductor or an insulator either directly or after being applied with an appropriate insulator, if necessary. By employing such a construction, it becomes possible to form a booth with said wall bodies and thereby construct the electrostatic powder painting apparatus according to the present invention integrally with the booth.

With regard to the powder supply means in the novel electrostatic powder painting apparatus according to the present invention, every powder supply means known in the prior art such as, for example, a powder supply system in which after the powders have been fluidized with pressurized air fed from an air compressor the powders are pneumatically transported, could be employed. However, a part or a whole of the powder supply means, a contact type of electric field curtain that has been already proposed by the same inventor could be employed. In such a system an appropriate electrode group of either single-phase or multi-phase is disposed and applied with a single-phase or multi-phase voltage. By making use of the effect of the uneven alternating electric field, powder particles which have been inherently charged by themselves owing to their mutual contact charging are agitated and assisted in pneumatic transportation, and also owing to the effect of the travelling wave uneven electric field generated by multi-phase alternating electric fields the powder particles are conveyed.

With regard to the mode of supply of the powders to the charging/driving system, (1) an appropriate gap space could be provided between said discharge electrode and said driving electrode so that the powders may be supplied through said gap space from the back side towards the front side (the direction toward the body to be painted), (2) the powders could be supplied from a side of said charging/driving system to its front side, or else (3) a cavity could be provided within either one or both of said discharge electrode and said driving electrode, said cavity being provided with a powder feed port and a powder exhaust port opening outwards of said electrodes, so that the powders may be supplied through said feed port, cavity and exhaust port to the gap space between the respective electrodes of said charging/discharging system.

In addition, it is to be noted that said discharge electrode and said driving electrode could be made of any appropriate material, and that either one or both of said electrodes could be covered with an appropriate semiconductor or insulator, and thereby sparks generated therebetween can be prevented.

Figure 2:
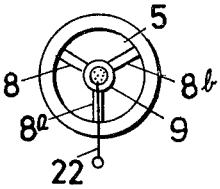
Figure 4:
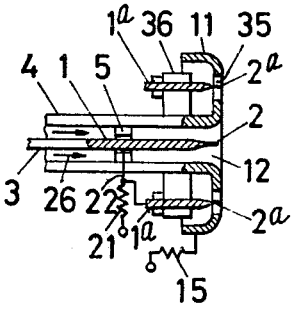
Figure 5:
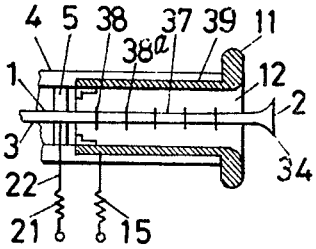
Figure 6:
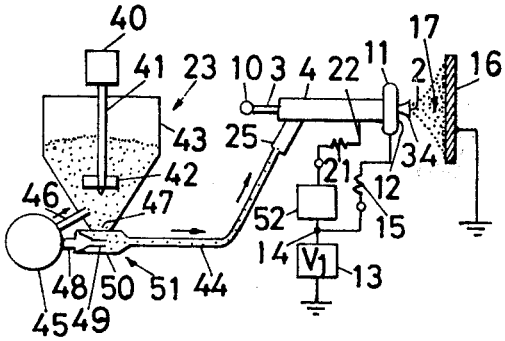
Figure 7:
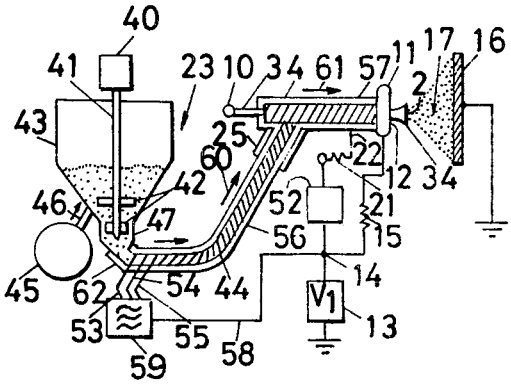
Figure 8:
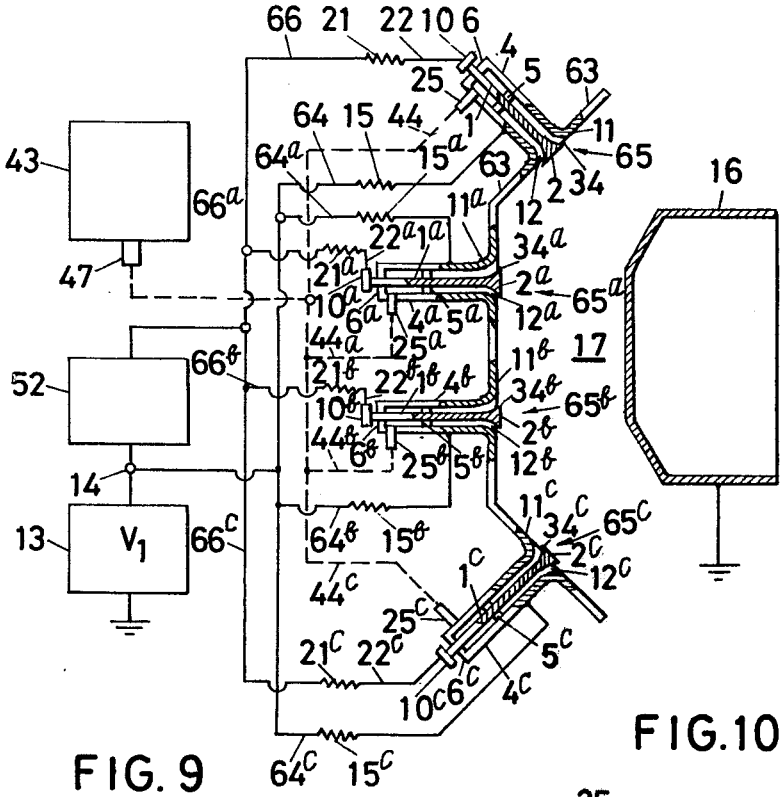
Figure 9:
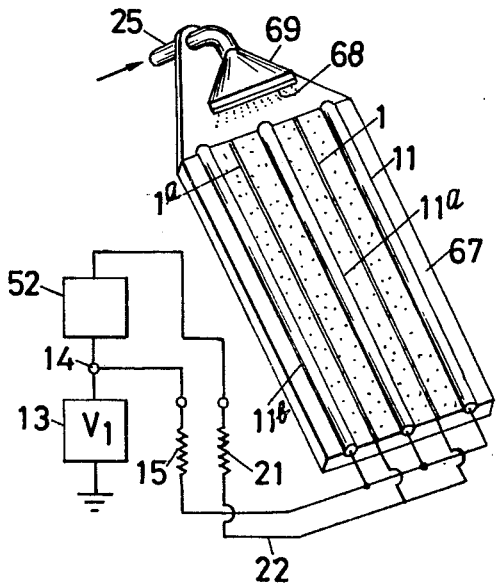
Figure 10:
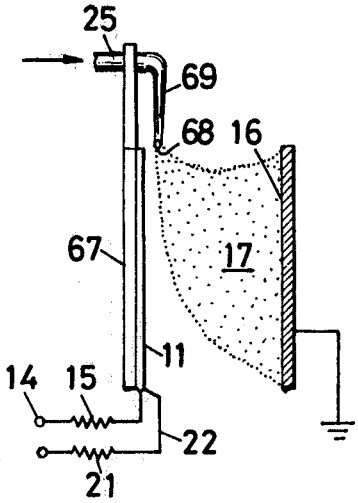

These and other features and objects of the present invention will become more apparent by reference to the following description taken in conjunction with the accompanying drawings, in which:

FIG. 1 is a longitudinal cross-section view of a principal part of one preferred embodiment of the present invention illustrated in association with a schematic circuit diagram of a voltage source section, FIG. 2 is an enlarged transverse cross-section view of one part of the embodiment shown in FIG. 1, FIGS. 3, 4 and 5 are longitudinal cross-section views of principal parts of alternative preferred embodiments of the present invention, FIG. 6 is a general construction view of the preferred embodiment whose principal part is shown in FIGS. 3 and 5, FIGS. 7 and 8 are general construction views of modified embodiments of the present invention, FIG. 9 is a perspective view of still another preferred embodiment of the present invention, and FIG. 10 is a side view of the embodiment shown in FIG. 9.

Referring now to the drawings, one preferred embodiment of the present invention in which the discharge electrode is embodied as a needle-shaped electrode and the driving electrode is embodied as a toroidal electrode, is shown in longitudinal cross-section in FIG. 1. In this figure, reference numeral 1 designates a needle-shaped discharge electrode having a corona discharge portion 2 consisting of a needle point at its front end and having a support rod 3 consisting of an insulator fixedly secured to its rear end. This discharge electrode is supported on an axis of an insulator cylinder 4 coaxially therewith and fitted in bores 7 provided at the centers of a support arm 5 and a bottom plate 6. A transverse cross-section view of the support arm 5 taken along a cross-section perpendicular to its axis is shown in FIG. 2, in which said support arm 5 consists of three posts 8, 8*a* and 8*b* and a small cylinder 9 that is supported by these posts and which slidably supports the discharge electrode 1. The support rod 3 penetrates through the bore 7 in an airtight and slidable manner and is provided with a handle 10 at its rear end, so that by displacing this handle back and forth the position of the needle-point discharge portion 2 can be adjusted properly.

Reference numeral 11 designates a toroidal driving electrode mounted at a forward opening end 12 of the insulator cylinder 4 coaxially therewith, and in the vicinity of the center of the driving electrode 11 is positioned the aforementioned corona discharge portion 2. Reference numeral 13 designates a driving D.C. high voltage source which is grounded at one end and is connected at the other end to the driving electrode 11 via an output terminal 14 and a current limiting guard resistor 15, in the illustrated embodiment, a negative D.C. high voltage $V_1$ relative to the body 16 to be painted which is then grounded is applied to the driving electrode 11, so that in the space between the driving electrode 11 and the body 16 is established a driving electric field $E_1$ which drives negatively charged powders in the direction of arrow 18. Reference numeral 19 designates a charging variable D.C. high voltage source which is connected at one end to the terminal 14 and is connected at the other end to the discharge electrode 1 via a transfer switch 20, a current limiting guard resistor 21 and a conductor 22 thus between the driving electrode 11 and the discharge electrode 1 there is applied a variable D.C. high voltage $V_2$ which is, in the illustrated embodiment, more negative at the latter. Thereby a negative corona discharge is generated from the needle-point discharge portion 2 towards the body 16 to be painted or further extending towards the driving electrode 11, and thus a negative ion current is supplied. In this case, by varying the magnitude of the applied voltage $V_2$, the concentration of electric lines of force, that is, an electric field strength at the needle-point discharge portion 2 can be arbitrarily controlled, and thereby the magnitude of the negative ion current flowing from said discharge portion 2 towards the body 16 to be painted and further towards the driving electrode 11 can be controlled quite independently of the driving electric field $E_1$.

By means of a powder supply system 23 (See FIGS. 6 and 7) that is omitted in FIG. 1, paint powders are supplied to within the cylinder 4 through a powder inlet section 25 serving also as a handle which is provided at a base portion 24 of the insulator cylinder 4. The powders travel in the direction of arrow 26 to be supplied from the opening end 12 to the space region 17 where the driving electric field $E_1$ is established. Thereupon, during the process or passing through the gap space between the discharge portion 2 and the driving electrode 11 and being exhausted forwardly, the powders are strongly and negatively charged upon collision with the negative ion current, so that they are driven towards the surface of the body 16 to be painted owing the Coulomb's force generated by the driving electric field and thus adhered onto the surface. In this case, while the driving electric field $E_1$ is maintained at the maximum permissible strength by raising the voltage $V_1$ as high as possible, the corona current density can be controlled quite independently of the driving electric field $E_1$ by varying the voltage $V_2$ so as to always satisfy the condition represented by formula (1) above. Therefore, the function and effect inherent to the present invention as described previously can be realized, and thus the excellent painting efficiency and painting quality can be attained.

In addition, reference numeral 27 designates a variable A.C. high voltage source for supplying a sinusoidal alternating voltage $Va \sin 2\pi ft$ ($Va$ representing a peak voltage value, $f$ a frequency and $t$ representing time). Numeral 28 designates a variable D.C. high voltage source connected at one end to said variable A.C. high voltage source and at the other end to the terminal 14 for supplying a bias D.C. voltage $V_3$ that is more positive at said one end, and by making at least one of the peak voltage $Va$, frequency $f$ and bias voltage $V_3$ variable, the voltage sources 27 and 28 jointly form a single variable periodic voltage source 29 for charging. Thus by transferring the switch 20, between the discharge electrode 1 and the driving electrode 11 is applied a variable periodic voltage ($V_3 + Va \sin 2\pi ft$) in which at least one of the peak voltage $Va$, frequency $f$ and bias voltage $V_3$ is variable, so that in one period of the A.C. voltage $T = 1/f$, only during a certain interval $\Delta T$ that is determined by these variables, corona discharge will arise from the corona discharge portion 2 towards the body 16 to be painted, and further extending towards the driving electrode 11. Therefore, a negative ion current can be fed from the corona discharge portion 2 towards the body 16 to be painted and further towards the driving electrode 11, which ion current can be arbitrarily controlled independently of the driving electric field $E_1$ by controlling these variables. Accordingly, the excellent function and effect which are inherent to the present invention as described previously, can be achieved.

Still further, reference numeral 30 designates a variable repetitive high voltage pulse voltage source which can supply a repetitive negative pulse voltage $\phi(Vp, \tau, T, t)$ having a peak voltage value $Vp$, a pulse width $\tau$ and a period of repetition. Reference numeral 31 designates a variable D.C. high voltage source connected at one end to said repetitive pulse voltage source in series and at the other end to said terminal 14 for supplying a bias D.C. voltage $V_4$ that is more positive at said one end. By making at least one of the peak voltage value $Vp$ pulse width $\tau$, period T and bias voltage $V_4$ variable, the voltage sources 30 and 31 jointly form a single variable periodic voltage source 32 for charging. By transferring the switch 20, between the discharge electrode 1 and the driving electrode 11 there is applied a periodic voltage $[V_4 = \phi(Vp, \tau, T, t)]$ in which at least one of the peak voltage $Vp$, pulse width $\tau$, period T and bias voltage $V_4$ is variable, so that only at the moment when the pulse voltage is applied, negative corona discharge will arise from the corona discharge portion 2. Thus a negative ion current which is determined by the peak voltage $Vp$, pulse width $\tau$, period T and bias voltage $V_4$ flows from the corona discharge portion 2 towards the body 16 to be painted or further towards the driving electrode 11. Accordingly, by controlling these variables the negative ion current can be controlled arbitrarily and quite independently of the driving electric field $E_1$, and thereby the excellent function and effect which are inherent to the present invention as described previously can be achieved.

Reference numeral 33 designates a charging periodic voltage source which can supply a general variable periodic high voltage having any arbitrary waveform and frequency. By connecting one end of the voltage source to the terminal 14 and the other end to the discharge electrode 1 through a transfer contact of the switch 20, guard resistor 21 and conductor 22, a variable periodic voltage can be applied between the driving electrode 11 and the discharge electrode 1, so that a variable periodic corona discharge is generated from the corona discharge portion 2. Thus a variable periodic negative ion current which can be arbitrarily controlled quite independently of the driving electric field $E_1$ by varying the waveform and/or frequency of said periodic high voltage, can be fed from the corona discharge portion 2 towards the body 16 to be painted or further towards the driving electrode 11. Therefore, the excellent function and effect that is inherent to the present invention as described previously, can be achieved.

Figure 3:
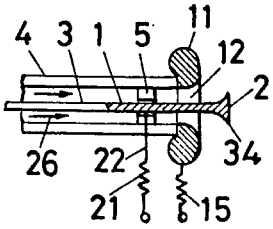

FIG. 3 is a longitudinal cross-section view of a principal part of a modified embodiment of the present invention in which the corona discharge portion 2 of the discharge electrode 1 shown in FIGS. 1 and 2 is modified into an inverse-conical shape. Except for the fact that corona discharge will arise from an annular sharp edges 34 formed along the circumference of the bottom surface, this embodiment is exactly the same as that shown in FIGS. 1 and 2, the names and functions of the elements designated by numerals 1 to 26 in FIG. 3 are the same as those of the elements designated by like numerals in FIGS. 1 and 2, and the voltage sources and the associated circuit are omitted in FIG. 3. According to this modified embodiment, because the corona discharge portion is formed in an inverse-conical shape, dispersion of the powders exhausted from the opening 12 is improved. An advantage is obtained in that the charging of the powders becomes more effective and the painting efficiency is further enhanced. With regard to the other operations, functions and effects, the embodiment shown in FIG. 3 is exactly the same as that shown in FIGS. 1 and 2, and therefore, more detailed explanation will be omitted.

FIG. 4 is a longitudinal cross-section view of a principal part of another modified embodiment of the present invention, in which the discharge electrodes 1 similar to that shown in FIGS. 1 and 2 are provided in multiple. In addition to the discharge electrode 1 provided on the axis of the insulator cylinder 4, a plurality of holes 35 are provided in the driving electrode 11 and a plurality of needle-shaped discharge electrodes **1*a* are fixedly supported and insulated outside of the insulator cylinder 4 by means of insulators 36 so that the needle-point discharge portions 2*a* may be positioned at the centers of said holes 35, and also connected to conductors 22, respectively. The names and functions of the other elements designated by numerals 1 to 26 in FIG. 4 are the same as those of the elements designated by like numerals in FIGS. 1 and 2, and the voltage sources and the associated circuit are omitted in FIG. 4. According to this modified embodiment, because the corona discharge portions 2 and 2*a*** are provided in multiple, the current distribution within the driving electric field and within the adhered powder layer on the surface of the body to be painted becomes more uniform, so that an advantage is obtained in that the painting efficiency as well as the painting quality can be further enhanced.

FIG. 5 is a longitudinal cross-section view of a principal part of another modified embodiment of the present invention, in which the embodiment shown in FIG. 3 is further modified in such manner that on the main shaft portion 37 of the discharge electrode 1 located within the insulator cylinder 4 are also mounted disc-shaped discharge portions **38, 38*a*, . . . . to further improve the charging of the powders. The inside portion of the toroidal driving electrode 11 are extended to the inside of the insulator cylinder 4 in tight contact thereto and coaxially therewith in correspondence to the provision of the disc-shaped discharge portions so as to be opposed to the disc-shaped discharge portions 38, 38*a*, . . . . The names and functions of the other elements designated by numerals 1 to 34 are the same as those of the elements designated by like numerals in FIG. 3, and the voltage sources and the associated circuits are omitted in FIG. 5**. By improving the charging of the powders with the above-described modified charging system, in addition to the excellent function and effect that is inherent to the present invention, further improvement in the painting efficiency can be achieved.

FIG. 6 is a general construction view of the embodiment shown in FIG. 3 or 5, in which one example of a powder supply system 23 is illustrated in detail. In particular, the powder supply system 23 comprises a powder tank 43 in which there are provided stirring blades 42 having a vertical arm 41 that is rotated by an electric motor 40, a flexible pipe 44 for pneumatically transporting the powders, and a compressor 45 for supplying pressurized air. A part of the pressurized air supplied from the compressor 45 is fed to the bottom portion of the powder tank 43 through a pipe 46 to maintain the powders within the tank 43 in a fluidized state in cooperation with the rotary stirring effect of the stirring blades 42 and thus facilitate the flow-out of the powders. A bottom exhaust port 47 of the powder tank 43 opens at one side of a jet ejector 51 consisting of a nozzle 49 that is supplied with pressurized air from the compressor 45 via a pipe 48 and is adapted to eject the pressurized air rightwards. A tubular body 50 surrounds said nozzle 49. The powders sucked from the bottom of the powder tank 43 by the action of the ejected air, are supplied jointly with an air flow to the interior of the cylinder 4 via the flexible pipe 44 and through the powder inlet section 25 serving also as a handle of the insulator cylinder 4. Reference numeral 52 representatively indicates any one of the variable charging high voltage sources 19, 29, 32 and 33 illustrated in FIG. 1. The elements designated by reference numerals 2 to 25 in FIG. 6 have the same names and functions as those of the elements designated by identical numerals in FIG. 3 or 5. The powders introduced to the interior of the insulator cylinder 4 through the powder inlet section 25, are supplied via the opening 12 and through the gap space between the driving electrode 11 and the corona discharge section 34 to the front space 17. During this process the powders are intensely charged and efficiently driven to the surface of the body 16 to be painted according to the excellent function and effect that is inherent to the present invention, and thereby a painted layer of high quality can be formed.

FIG. 7 is a general construction view of a modified embodiment of the present invention, in which the embodiment shown in FIG. 6 is modified in such manner that for the purpose of transportation of powders an electric field curtain is employed in place of the pneumatic transportation system. More particularly, around the powder transportation pipe 44 and the insulator cylinder 4 are disposed three coated wires 53, 54 and 55 wound in a spiral manner, and further insulator coatings 56 and 57 are provided over the coated wires. The above-referred wires 53, 54 and 55 are respectively connected to output terminals of a three-phase A.C. high voltage source 58 whose neutral point 59 is connected to the terminal 14, and thereby a travelling wave uneven electric field travelling in the direction of arrows 60 and 61 is established in the interior of said pipe 44 and the insulator cylinder 4. All the elements designated by the other numerals have the same name and function as the elements designated by like numerals in FIG 6. Now the powders supplied to the inlet end 62 of the pipe 44 from the bottom exhaust port 47 of the powder tank 43 are always charged intensely in a positive or negative polarity through a contact charging effect. Thus the charged powders are transported in the direction of the travelling wave, that is, in the direction of arrows 60 and 61 by the action of said travelling wave uneven electric field regardless of the polarity of the electric charge carried thereby, and are thus exhausted from the opening 12 to the region 17. Then the exhausted powders are charged by the ion current and adhered onto the body 16 to be painted. Exactly in the same manner as the preceding embodiments, the excellent function and effect that is inherent to the present invention can be attained during this process. It is to be noted that according to this embodiment, since the pneumatic transportation is not employed for transporting and supplying the powders, the initial velocity of the powders at the opening 12 can be made slow, and thereby a remarkable advantage can be obtained in that the charging of the powders can be achieved more effectively.

FIG. 8 is a longitudinal cross-section view of one preferred embodiment of the present invention, in which a plurality of powder charging/driving systems as shown in FIGS. 3 and 6 are mounted on a wall body 63 made of an insulator. In this figure, an output voltage of a driving D.C. high voltage source 13 is applied from a terminal 14 through conductors 64, 64*a*, . . . . and guard resistors 15, 15*a*, . . . . to driving electrodes 11, 11*a*, . . . . of the respective charging/driving systems 65, 65*a*, . . . . In addition, one end of an output of a charging variable high voltage source 52 is connected to the terminal 14, and the other end is connected to the respective discharge electrodes 1, 1*a*, . . . . through conductors 66, 66*a*, . . . . and guard resistors 21, 21*a*, . . . . It is to be noted that according to this embodiment, all the parts including the discharge electrodes 1, 1*a*, . . . . to the handles 10, 10*a*, . . . . are made of conductors. Furthermore, the powders pneumatically transported from the outlet 47 of the powder tank 43, are supplied to the respective powder inlet sections 25, 25*a*, . . . . through transportation pipes represented by dash-lines 44, 44*a*, . . . ., respectively, and exhausted forwardly through the respective openings 12, 12*a*, . . . . During this process, the powders are intensely charged by the ion current, so that they travel through the forward region 17 as driven by the driving electric field, and as a matter of course, they are adhered onto the body 16 to be painted while achieving the excellent function and effect that is inherent to the present invention. It is to be noted that by integrally constructing the wall body 63 and the charging/driving systems as is the case with the above-described embodiment, a large-sized wide body can be painted in one operation, and especially when a painting space is surrounded by said wall bodies 63 to form a booth, spattering of the powders during painting operation can be prevented, and also recovery of the paint powders is facilitated, so that the producibility of the painting work can be enhanced. The names and functions of the elements designated by reference numerals 1 to 34 in this figure are the same as those of the elements designated by like numerals in FIGS. 3 and 6.

FIG. 9 is a perspective view of another preferred embodiment of the present invention, in which the charging/driving system according to the present invention is constructed in such manner that the driving electrodes are formed by a group of cylindrical conductors 11, 11*a*, . . . . and arranged in parallel to each other at equal intervals on an insulator plate 67, and between the adjacent driving electrodes are disposed discharge electrodes consisting of a group of parallel thin wires 1, 1*a*, . . . . FIG. 10 is a side view of the same embodiment. It is to be noted that the driving electrodes are disposed as embedded by half in an insulator plate 67 as shown in these figures. When an output terminal 14 of a driving D.C. high voltage source whose one end is grounded, is connected to the cylindrical driving electrode group 11, 11*a*, . . . . via a guard resistor 15, in the region 17 between the driving electrode group and the grounded body 16 to be painted there is established a driving electric field. When one end of a variable high voltage source 52 of either D.C. voltage or periodic voltage of any arbitrary waveform for charging is connected to the terminal 14 and the other end is connected to the thin wire discharge electrode group 1, 1*a*, . . . . via a guard resistor 21 and a conductor 22, then the discharge electrode group 1, 1*a*, . . . . generate variable corona discharge, and thereby an ion current that can be varied quite independently of the driving electric field is fed to the body 16 to be painted or further towards the driving electrode group 11, 11*a*, . . . . Powders are introduced to a powder inlet section 25 of a flat exhaust head 69 having a slit-shaped injection nozzle 68 jointly with an air flow by means of an appropriate powder supply system 23. The powders are injected from one side of the charging/driving system consisting of the driving electrode group 11, 11*a*, . . . . the discharge electrode group 1, 1*a*, . . . ., and the insulator plate 67, through said slit-shaped injection nozzle 68 towards the front space of the charging/driving system in parallel thereto. The powders are thus intensely charged and adhered onto the body 16 to be painted. Thereupon, similarly to the previously described respective embodiments, a high painting efficiency and high painting quality can be obtained owing to the excellent function and effect that is inherent to the present invention. The structure according to this particular embodiment is suitable for painting a larged-sized or wide body in one operation.

While the characteristic structural features of the present invention have been described above in connection to its various embodiments, it is a matter of course that the structural features of the present invention can be realized with many other appropriate constructions, configurations and materials.

While the electrostatic powder painting apparatus according to the present invention is mainly used for electrostatic powder painting, in which a paint film is formed on the surface of the body to be painted after the adhered powders have been molten through a process of appropriate heating (for instance, by means of a resistance type of electric furnace, an induction type of heating furnace, a high frequency heating device, an infra-red ray heating device, etc.), electron beam irradiation, and other appropriate methods, besides the above application; the subject apparatus can be used for every purpose of adhering various powders, short fibers, etc. onto a surface of a body.

What is claimed is:

1. An electrostatic powder painting apparatus characterized in that said apparatus comprises a discharge electrode including a corona discharge portion having a small radius of curvature for producing corona discharge for charging powders, a driving electrode having a large radius of curvature which is disposed in the vicinity of said corona discharge portion and insulated from said discharge electrode, powder supply means for supplying paint powders to the vicinity of a corona discharge space formed between said corona discharge portion of said discharge electrode and said driving electrode, a driving D.C. high voltage source coupled between said driving electrode and a body to be painted for applying a D.C. high voltage between said body to be painted and said driving electrode to establish a driving electric field which drives the charged powders towards said body to be painted to be adhered thereto, and a charging variable high voltage source coupled between said discharge electrode and said driving electrode for applying a variable high voltage between said discharge electrode and said driving electrode to produce a variable corona discharge current consisting of a flow of ions of the same polarity as said driving electrode relative to said body from said corona discharge portion of said discharge electrode to said driving electric field, whereby said powders may be charged, driven and electrostatically adhered onto said body to be painted while controlling the magnitude of said corona current independently of said driving electric field in a manner to accommodate the nature of the paint powders employed.

2. An electrostatic powder painting apparatus as claimed in claim 1, further characterized in that said charging variable high voltage source comprises a variable D.C. high voltage source.

3. An electrostatic powder painting apparatus as claimed in claim 1, further characterized in that said charging variable high voltage source comprises a periodic voltage source for supplying a periodic voltage whose voltage and/or frequency is variable.

4. An electrostatic powder painting apparatus as claimed in claim 3, further characterized in that said periodic voltage source comprises a sinusoidal A.C. voltage source.

5. An electrostatic powder painting apparatus as claimed in claim 3, further characterized in that said periodic voltage source comprises a repetitive pulse voltage source.

6. An electrostatic powder painting apparatus as claimed in claim 3, further characterized in that said periodic voltage source comprises a pulsating voltage source.

7. An electrostatic powder painting apparatus as claimed in claim 1, further characterized in that said charging variable high voltage source comprises a periodic voltage source and a D.C. voltage source serially coupled to said periodic voltage source wherein at least one of the voltage and frequency of said periodic voltage source and the voltage of said D.C. voltage source being variable.

8. An electrostatic powder painting apparatus as claimed in claim 1, further characterized in that said corona discharge portion of said discharge electrode is axially symmetrical and said driving electrode is surrounds said corona discharge portion of said discharge electrode.

9. An electrostatic powder painting apparatus as claimed in claim 1, further characterized in that a plurality of discharge electrodes and driving electrodes are integrally and fixedly disposed with respect to each other and coupled in parallel to said voltage sources.

10. An electrostatic powder painting apparatus as claimed in claim 1, further characterized in that said discharge electrode and said driving electrode are spaced to provide a gap space therebetween, and the paint powders are supplied through said gap to the driving electric field.

11. An electrostatic powder painting apparatus as claimed in claim 1, further characterized in that at least one of said discharge electrode or said driving electrode is covered with an insulator.

12. An electrostatic powder painting apparatus as claimed in claim 1, further characterized in that said powder supply means includes a contact electric field curtain.

13. An electrostatic powder painting apparatus characterized in that said apparatus comprises a discharge electrode including a corona discharge portion having a small radius of curvature for producing corona discharge for charging powders, a driving electrode having a large radius of curvature which is disposed in the vicinity of said corona discharge portion and insulated from said discharge electrode, powder supply means for supplying paint powders to the vicinity of a corona discharge space formed between said corona discharge portion of said discharge electrode and said driving electrode, a driving D.C. high voltage source coupled between said driving electrode and a body to be painted for applying a D.C. high voltage between said body to be painted and said driving electrode to establish a driving electric field which drives the charged powders towards said body to be painted to be adhered thereto, and a charging variable high voltage source coupled between said discharge electrode and said driving electrode for applying a variable high voltage between said discharge electrode and said driving electrode to produce a variable corona discharge current consisting of a flow of ions of the same polarity as said driving electrode relative to said body from said corona discharge portion of said discharge electrode to said driving electric field, whereby said powders may be charged, driven and electrostatically adhered onto said body to be painted while controlling the magnitude of said corona current independently of said driving electric field in a manner to accommodate the nature of the paint powders employed, wherein said corona discharge portion of said discharge electrode comprises a row of aligned members, each member having a relatively sharp edge facing said body and said driving electrode comprises a plurality of sections surrounding and spaced from said members.

14. An electrostatic powder painting apparatus characterized in that said apparatus comprises a discharge electrode including a corona discharge portion having a small radius of curvature for producing corona discharge for charging powders, a driving electrode having a large radius of curvature which is disposed in the vicinity of said corona discharge portion and insulated from said discharge electrode, powder supply means for supplying paint powders to the vicinity of a corona discharge space formed between said corona discharge portion of said discharge electrode and said driving electrode, a driving D.C. high voltage source coupled between said driving electrode and a body to be painted for applying a D.C. high voltage between said body to be painted and said driving electrode to establish a driving electric field which drives the charged powders towards said body to be painted to be adhered thereto, and a charging variable high voltage source coupled between said discharge electrode and said driving electrode for applying a variable high voltage between said discharge electrode and said driving electrode to produce a variable corona discharge current consisting of a flow of ions of the same polarity as said driving electrode relative to said body from said corona discharge portion of said discharge electrode to said driving electric field, whereby said powders may be charged, driven and electrostatically adhered onto said body to be painted while controlling the magnitude of said corona current independently of said driving electric field in a manner to accommodate the nature of the paint powders employed and further characterized in that a pluraity of discharge electrodes a driving electrodes are integrally and fixedly disposed with respect to each other and coupled in parallel to said voltage sources, and said plurality of discharge electrodes and driving electrodes are positioned on a wall.

15. An electrostatic powder painting apparatus characterized in that said apparatus comprises a discharge electrode including a corona discharge portion having a small radius of curvature for producing corona discharge for charging powders, a driving electrode having a large radius of curvature which is disposed in the vicinity of said corona discharge portion and insulated from said discharge electrode, powder supply means for supplying paint powders to the vicinity of a corona discharge space formed between said corona discharge portion of said discharge electrode and said driving electrode, a driving D.C. high voltage source coupled between said driving electrode and a body to be painted for applying a D.C. high voltage between said body to be painted and said driving electrode to establish a driving electric field which drives the charged powders towards said body to be painted to be adhered thereto, and a charging variable high voltage source coupled between said discharge electrode and said driving electrode for applying a variable high voltage between said discharge electrode and said driving electrode to produce a variable corona discharge current consisting of a flow of ions of the same polarity as said driving electrode relative to said body from said corona discharge portion of said discharge electrode to said driving electric field, whereby said powders may be charged, driven and electrostatically adhered onto said body to be painted while controlling the magnitude of said corona current independently of said driving electric field in a manner to accommodate the nature of the paint powders employed, and wherein at least one of said dischare electrode or said driving electrode includes a cavity, said cavity being provided with a powder feed port and a powder exhaust port opening outwards of said electrodes, and the paint powders are supplied through said feed port, cavity and exhaust port to the gap space between the respective electrodes.

16. In an electrostatic powder coating apparatus including a discharge electrode disposed in confronting relation to a body to be coated and a powder supplying means for supplying a coating material to the vicinity of said discharging electrode, wherein the improvement comprises:

a driving electrode disposed in confronting relation to a body to be painted and in the vicinity of said discharge electrode;

a driving D.C. high voltage source coupled between a body to be painted and said driving electrode; and a charging variable high voltage source coupled between said discharge electrode and said driving electrode and having a voltage selected for maximizing the electrical field between said driving electrode and a body to be painted and preventing inverse ionization between the body to be coated and said apparatus.

* * * * *

UNITED STATES PATENT AND TRADEMARK OFFICE

CERTIFICATE OF CORRECTION

PATENT NO. : 4,011,991

DATED : March 15, 1977

INVENTOR(S) : Senichi Masuda

It is certified that error appears in the above-identified patent and that said Letters Patent are hereby corrected as shown below:

Column 6, line 67:

After "repetition" insert -- T --.

Column 7, line 10:

"=" should be -- + --.

Column 11, line 14:

"larged-sized" should be -- large-sized --.

Column 12, line 31:

After "electrode" delete -- is --.

Column 13, line 52:

"pluraity" should be -- plurality --.

Column 13, line 52: "a" should be -- and -- (2nd occurrence)

Signed and Sealed this

*fifth* Day of *July 1977*

[SEAL]

*Attest:*

RUTH C. MASON
*Attesting Officer*

C. MARSHALL DANN
*Commissioner of Patents and Trademarks*